US006997100B1

(12) United States Patent
Belanger et al.

(10) Patent No.: US 6,997,100 B1
(45) Date of Patent: Feb. 14, 2006

(54) IMPACT PLATE FOR COMPONENT ASSEMBLY

(75) Inventors: Rene F. Belanger, Holyoke, MA (US); Francis Marocchini, Somers, CT (US)

(73) Assignee: Hamilton Sundstrand, Windsir Locks, CT (US)

( * ) Notice: Subject to any disclaimer, the term of this patent is extended or adjusted under 35 U.S.C. 154(b) by 0 days.

(21) Appl. No.: 10/897,445

(22) Filed: Jul. 23, 2004

(51) Int. Cl.
*F01B 11/02* (2006.01)

(52) U.S. Cl. ..... 92/85 R

(58) Field of Classification Search ..... 92/85 R, 92/129
See application file for complete search history.

(56) References Cited

U.S. PATENT DOCUMENTS

| | | | | |
|---|---|---|---|---|
| 3,805,672 | A * | 4/1974 | Pekrul | 92/85 R |
| 3,913,460 | A * | 10/1975 | Wright | 92/85 R |
| 4,593,606 | A * | 6/1986 | Klatt et al. | 92/85 R |
| 4,667,475 | A * | 5/1987 | Wesman | 92/85 R |
| 5,309,817 | A * | 5/1994 | Sims | 92/85 A |

* cited by examiner

*Primary Examiner*—Edward K. Look
*Assistant Examiner*—Michael Leslie
(74) *Attorney, Agent, or Firm*—Carlson, Gaskey & Olds

(57) ABSTRACT

An impact plate for use in a component having parts that move at high velocity, such as a piston or valve, controls energy transfer during impact of the moving part. The impact plate has a recessed inner portion that acts as an impact surface and an outer support surface to hold the impact plate within a housing of the component. The impact surface has a selected, controlled spring rate so that it can deflect and absorb impact forces when the moving part contacts it.

15 Claims, 1 Drawing Sheet

IMPACT PLATE FOR COMPONENT ASSEMBLY

This invention was made with government support under Contract No. N00019-02-C-3003. The U.S. Government therefore has certain rights in this invention.

TECHNICAL FIELD

The present invention relates to a device that can stop high-velocity moving parts within a component assembly.

Component assemblies containing high-velocity moving parts, such as pistons and valves, are becoming more commonplace as technology demands faster responses from many different types of systems. As the desired velocity of pistons and valves increase, however, the handling of the resulting increase in kinetic energy poses a challenge. More particularly, an impact load of the moving part against a component housing surface may potentially create forces that exceed allowable levels, increasing the likelihood of cracks and fractures in the housing.

As is known in the art, an impact load is a function of the spring rate of the parts being impacted. A low spring rate will lower the impact load but can result in high stress. Thus, balancing the allowable stress level with the lowest possible spring rate is important in preserving the structural integrity of the component. This problem is made more complex when the impact load occurs in a pressurized cavity of a housing, which is common in hydraulic systems. Housing walls for the pressurized cavity must be made to handle total loads, which includes both a pressure load inside the cavity and the impact load. However, increasing the wall thickness of the impact surface increases the spring rate and in turn increases the impact load, creating a cycle that feeds upon itself and results in unmanageable stress levels.

In as much as impact loads, spring rates, and pressure loads are interrelated in the design of a component housing, it becomes exceedingly difficult to create a structure that can handle both high pressure and high impact loads without exceeding allowable stress levels.

Currently known components address this problem by using complex springs or hydraulic methods of absorbing the energy of the high velocity moving parts. However, these methods can result in increased hardware complexity, size, weight, and cost. In some instances, these methods may also increase internal fluid leakage, which can be detrimental to system performance.

There is a desire for an efficient system that can stop high velocity parts by divorcing the energy absorbing requirements from the housing of the component.

SUMMARY OF THE INVENTION

The invention is directed to an impact plate that controls energy transfer during impact of a moving part, such as a piston or valve, within a housing of a component. The impact plate has a recessed inner portion that acts as a resilient impact surface and a thicker outer support surface to hold the impact plate within a bore of the housing. The impact surface has a selected, controlled spring rate so that it can deflect and absorb impact forces when the moving part contacts it at a high velocity.

When the moving part contacts the impact surface of the impact plate, the impact surface deflects and absorbs the resulting impact force. By absorbing impact loads in the impact plate and not the housing itself, the housing can be designed to satisfy hydraulic pressure and impact plate reaction loads without affecting the spring rate of the stop surface.

DETAILED DESCRIPTION OF THE PREFERRED EMBODIMENT

The invention is generally directed to an impact plate that controls energy transfer during an impact inside a component having a housing and at least one moving part, such as a piston or valve. The impact plate manages an impact load as the moving part contacts the impact plate, effectively controlling the magnitude of the impact load by excluding the spring rate of a housing surface. The portion of the impact plate that is contacted by the moving part has a lower spring rate than the spring rate that could be obtained from a housing surface designed to satisfy high pressure hydraulic requirements. The impact plate therefore provides a way to minimize impact loads without compromising the structural integrity of the housing.

Figure 1:
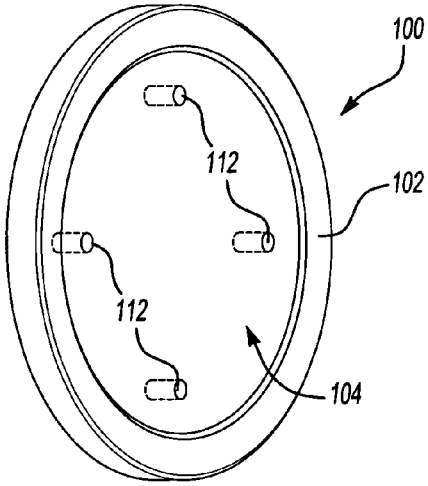
FIG. 1 is a perspective view of an impact plate according to one embodiment of the invention.
Figure 2:
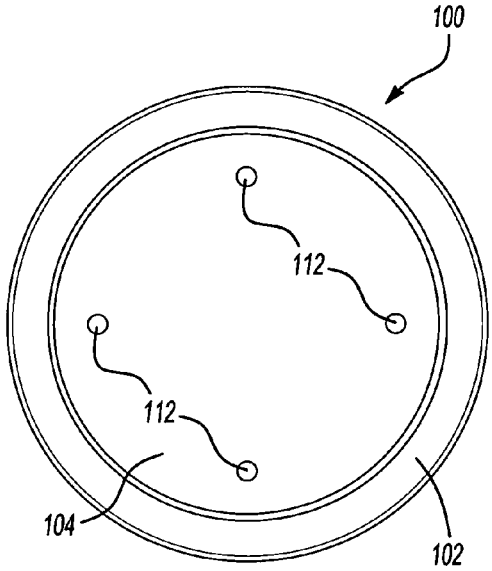
FIG. 2 is a plan view of the impact plate in FIG. 1.

FIGS. 1 and 2 illustrate an impact plate 100 according to one embodiment of the invention. The impact plate 100 includes a substantially rigid support surface 102 and a resilient impact surface 104. In the illustrated example, the impact plate 100 is a disk-shaped device, but the impact plate 100 may have any desired configuration appropriate for the component in which it will be used. In this example shown in FIG. 3, the circular shape of the impact plate 100 allows it to be self-aligning when installed in a bore 106 of a component housing 108.

Figure 3:
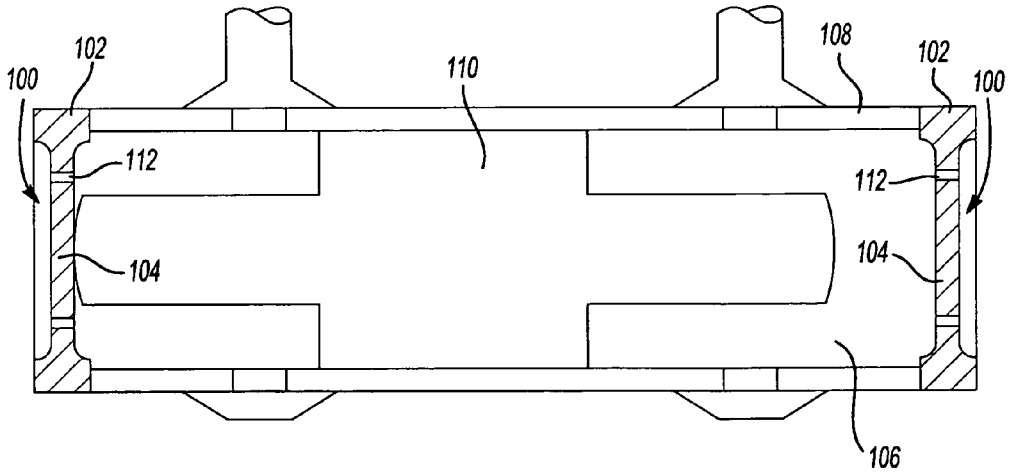
FIG. 3 is a schematic view of an example of the impact plate disposed in a component having a moving part.

As shown in FIGS. 1 through 3, the support surface 102 of the impact plate 100 is designed to engage with the bore 106 and act as a support frame for the impact surface 104. The support surface 102 is preferably thicker than the impact surface 104 to provide sufficient support of the impact plate 100 within the bore 106 and thereby ground the impact plate 100 in the housing 108. As is also clear from the figures, the impact surface 104 is positioned radially inwardly of the support surface 102.

The impact surface 104 is disposed in an area where a moving part 110 in the component would ordinarily impact the housing 108. The impact surface 104 is thinner than the support surface 102 to provide a lower spring rate and allow it to deflect in response to an impact force from the moving part 110. In one embodiment, the impact surface 104 is recessed sufficiently so that the support surface 102 provides enough clearance for the impact surface 104 to deflect upon impact and spring back into its original position.

The impact surface 104 and/or the support surface 102 may have a plurality of vent holes 112 to equalize fluid pressure (e.g., air pressure, fuel pressure, etc.) on both sides of the impact surface 104. The vent holes 112 also simplify insertion and removal of the impact plate 100 by providing structure that can be gripped by a tool.

In one embodiment, the impact surface 104 and the support surface are symmetrical along a plane of the impact plate 100, allowing the impact plate 100 to be installed within the housing 108 in any desired position.

The specific materials used to form the impact plate 100 and the specific dimensions can vary depending on the application in which the impact plate 100 will be used. Those of skill in the art will be able to determine the most appropriate materials and dimensions based on the anticipated impact loads in a given application and the spring rate needed to handle the impact loads. For example, the diameter of the impact surface 104 can be made smaller to increase the spring rate or larger to decrease the spring rate. The impact plate 100 may be manufactured from, for example, a polymer or a metal. Moreover, the impact plate 100 may either be manufactured as a unitary component from one material or include different materials for the impact surface 104 and the support surface 102.

FIG. 3 illustrates one example where the moving part 110 is a high-velocity valve and the bore 106 is a pressurized cavity. Note that the impact plate 100 can be disposed near any surface where the moving part 110 is expected to contact the housing 108. In this example, impact plates 100 are disposed at each end of the travel path of the moving part 110. The velocity and mass of the moving part 110 creates a given level of impact load, with increasing velocity resulting in increasing loads. The impact surface 104 of each impact plate 100 absorbs the impact load caused by the moving part 110 through deflection, resulting in an impact load that is a function of the spring rate of the impact surface 104 and not the spring rate of the housing 108. The vent holes 112 in the impact surface 104 ensure that the pressure on either side of the impact surface 104 is the same.

By using the inventive impact plate to isolate the effect of impact loads on a component housing, the invention makes it possible to preserve the performance of high velocity parts without any adverse effects on the housing. The impact plate manages and absorbs kinetic energy, allowing even high impact loads to be handled within the component without changing the characteristics of the housing. The impact plate therefore provides a simple way to manage impact loads while at the same time keeping stresses in the component below allowable levels.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. An impact plate for use in a component having a high velocity part, comprising:

an impact surface which is resilient relative to, a rigid support surface encompassing the impact surface, said support surface having a greater thickness than a thickness of said impact surface, and said impact surface being positioned radially inwardly of said support surface.

2. The impact plate of claim 1, wherein the impact plate is substantially disk-shaped.

3. The impact plate of claim 1, wherein the impact surface and the support surface are substantially symmetrical along a plane of the impact plate.

4. The impact plate of claim 1, wherein the impact plate is made as a unitary component such that the impact surface and the support surface are made of the same material.

5. The impact plate of claim 1, wherein the impact surface and the support surface are made from different materials.

6. An impact plate for use in a component having a high velocity part, comprising:

an impact surface which is resilient relative to, a rigid support surface encompassing the impact surface; and at least one vent hole disposed in the impact plate.

7. The impact plate of claim 6, wherein the support surface has a thickness that is greater than a thickness of the impact surface.

8. A component, comprising:

a housing having a bore with a first end and a second end;

a moving part disposed within the bore, wherein the moving part moves toward at least one of the first end and the second end; and at least one impact plate disposed in at least one of the first end and the second end, said at least one impact plate having an impact surface which is resilient relative to, a rigid support surface encompassing the impact surface and engaging the bore, said support surface having a greater thickness than a thickness of said impact surface, and said impact surface being positioned radially inwardly of said support surface.

9. The component of claim 8, wherein said at least one impact plate comprises a first impact plate disposed in the first end and a second impact plate disposed in the second end.

10. The component of claim 8, wherein the bore is a pressurized cavity.

11. The component of claim 8, wherein the moving part is one selected from the group consisting of a piston and a valve.

12. The component of claim 8, wherein the impact plate is substantially disk-shaped.

13. The component of claim 8, wherein the impact surface and the support surface are substantially symmetrical along a plane of the impact plate.

14. A component, comprising:

a housing having a bore with a first end and a second end;

a moving part disposed within the bore, wherein the moving part moves toward at least one of the first end and the second end;

at least one impact plate disposed in at least one of the first end and the second end, said at least one impact plate having an impact surface which is resilient relative to, a rigid support surface encompassing the impact surface and engaging the bore; and at least one vent hole disposed in the impact plate.

15. The component of claim 14, wherein the support surface has a thickness that is greater than a thickness of the impact surface.

* * * * *